US007472504B2

(12) United States Patent
Yu et al.

(10) Patent No.: US 7,472,504 B2
(45) Date of Patent: Jan. 6, 2009

(54) STEAM IRON HAVING TWO FLAT RESISTIVE ELEMENTS FOR HEATING THE SOLEPLATE

(75) Inventors: Shenhua Yu, Singapore (SG); Mohankumar Valiyambath Krishnan, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 22 days.

(21) Appl. No.: 11/718,970

(22) PCT Filed: Nov. 8, 2005

(86) PCT No.: PCT/IB2005/053666

§ 371 (c)(1),
(2), (4) Date: May 9, 2007

(87) PCT Pub. No.: WO2006/051483

PCT Pub. Date: May 18, 2006

(65) Prior Publication Data

US 2007/0289174 A1 Dec. 20, 2007

(30) Foreign Application Priority Data

Nov. 11, 2004 (EP) ..... 04105694

(51) Int. Cl.
*D06F 75/24* (2006.01)
*D06F 75/38* (2006.01)

(52) U.S. Cl. ..... 38/77.8

(58) Field of Classification Search ..... 38/77.7, 38/77.83, 82, 93; 219/251
See application file for complete search history.

(56) References Cited

U.S. PATENT DOCUMENTS 4,939,342 A * 7/1990 Frens et al. ..... 219/251
5,642,579 A * 7/1997 Netten et al. ..... 38/77.7
6,953,912 B2 * 10/2005 Alday Lesaga ..... 219/251

FOREIGN PATENT DOCUMENTS

EP 517673 * 12/1992
EP 1384808 1/2004
GB 2217352 * 10/1989
GB 2272226 * 5/1994

* cited by examiner

*Primary Examiner*—Ismael Izaguirre

(57) ABSTRACT

A steam iron having a soleplate and a steam generator comprises a heater circuit (40) having two parallel loops (44, 45), wherein a main soleplate heating element (41) is arranged in a first loop (44), and wherein an auxiliary soleplate heating element (42) and a steam generator heating element (43) are arranged in a second loop (45). In the second loop (45), a selector switch (46) is arranged, for either connecting the auxiliary soleplate heating element (42) or the steam generator heating element (43) to an electric power source (50). A position of the selector switch (46) is determinative of an operating condition of the heater circuit (40). In one possible operating condition, both soleplate heating elements (41, 42) are connected to the electric power source (50). In this operating condition, the soleplate is heated up fast, as all available electric power is used for heating the soleplate.

20 Claims, 3 Drawing Sheets

STEAM IRON HAVING TWO FLAT RESISTIVE ELEMENTS FOR HEATING THE SOLEPLATE

Figure 1:
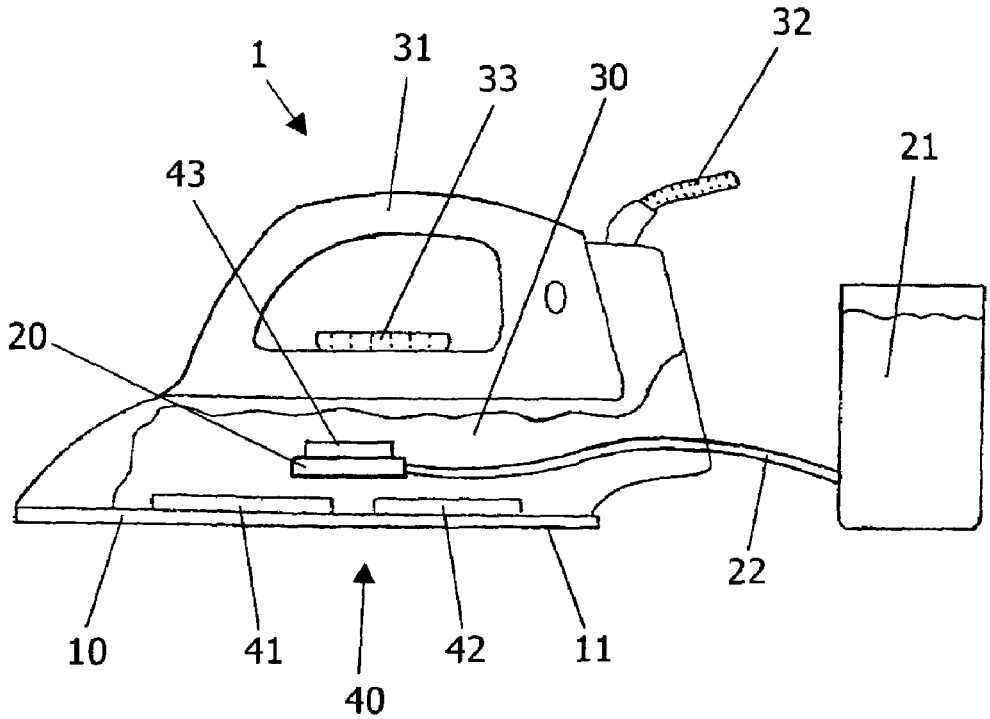

The present invention relates to a steam iron, comprising: a soleplate having a contacting surface for contacting items to be ironed; a steam generator; and heating elements for heating the soleplate and the steam generator.

Such a steam iron is well-known, and is an electric device which is often applied in a domestic context. Typically, in such context, the preferred maximum electric power usage is 2300 W. In view of the need to regulate the use of electric power, an International Electrotechnical Commission (IEC) has been established, which has the task of developing appropriate regulations. For example, in the field of electromagnetic compatibility (EMC), IEC-regulations stipulate that domestic appliances may not be switched on/off too frequently. This is an important point of interest with respect to steam irons, since steam irons comprise heating elements for heating the soleplate and the steam generator, which are frequently activated and deactivated, as a result of a continuous process of adapting the conditions of the soleplate and the steam generator to the requirements of a user. There is a need for utilizing the full electric power supply in order to enhance the performance of the steam iron, without violating IEC-regulations. In particular, there is need for increasing the steaming rate, i.e. the amount of steam delivered per unit of time, and for decreasing the heating-up time of the soleplate.

EP 1 384 808 discloses a steam iron, which comprises a boiler for containing water and heating water to steam, an ironing plate, and an electric device that is designed to distribute in a balanced manner, and exploit to the maximum, all the electric power available for letting the steam iron function. For this purpose, the electric device comprises two electric resistances arranged inside the boiler and one electric resistance arranged directly in contact with the ironing plate. Furthermore, the electric device comprises a switch. The configuration of the resistances and the switch is chosen such that in a first operating condition of the switch, only one of the resistances of the boiler is connected to a feeder, and that in a second operating condition of the switch, all three resistances are connected to the feeder, wherein the resistances of the boiler are connected in series, and wherein the resistance of the ironing plate is connected in parallel to the resistances of the boiler.

During operation of the known steam iron, one of the resistances of the boiler, which is referred to as first resistance, is always connected to the feeder. In the first operating condition of the switch, the first resistance is the only resistance connected to the feeder, and all available power is used for heating the boiler. In the second operating condition of the switch, all three resistances are connected to the feeder, wherein one fraction of the available power is used for heating the boiler, and wherein another fraction of the available power is used for heating the ironing plate.

In the field of steam irons, it is desirable to apply so-called flat resistive heating elements for heating the soleplate and the steam generator. For completeness' sake, it is noted that flat resistive heating elements are heating elements which are deposited as a thin layer on a surface by means of printing or other suitable techniques. Under the influence of an electric current, the flat resistive heating elements are capable of generating heat. For example, the flat resistive heating elements are formed by a layer of synthetic resin in which electrically conducting particles are embedded. When the flat resistive heating elements are arranged on a surface comprising an electrically conducting material such as metal, an electrically insulating layer needs to be arranged between the surface and the heating elements in order to avoid short-circuiting. Flat resistive heating elements can be arranged on planar surfaces, but it is also possible to arrange this type of heating elements on curved surfaces.

An important advantage of flat resistive heating elements is that these elements are very compact and lightweight in comparison with other types of heating elements. However, the application of flat resistive heating elements has limitations, as these heating elements are relatively fragile, especially at high temperature. Therefore, in order to obtain a reliable performance of flat resistive heating elements, it is preferred to let these heating elements function at low power density and low temperature. In a steam iron, the soleplate may be put to a temperature above 200° C., for example 210° C., so it is not possible to have a low temperature. Therefore, in order to be able to apply flat resistive heater elements in a steam iron, there is a need for measures for keeping the power density as low as possible, especially for flat resistive heating elements which are used for heating the soleplate of the steam iron.

In order to meet high demands regarding a reduction of the heating-up time of the soleplate and an increase of the steaming rate, there is a need for a steam iron in which it is possible to use all available power for heating the soleplate. It is an objective of the present invention to provide such a steam iron, while also admitting the possibility of applying flat resistive heating elements. The objective is achieved by a steam iron which comprises a main heating element and an auxiliary heating element, which are associated with the soleplate, and which, upon receipt of electric power, are capable of heating the soleplate; a heating element associated with the steam generator, which, upon receipt of electric power, is capable of heating the steam generator; and switching means for either connecting the heating element associated with the steam generator or the auxiliary heating element associated with the soleplate to a power source for supplying electric power.

According to the present invention, the steam iron comprises at least three heating elements, wherein at least two elements are associated with the soleplate, and wherein at least one heating element is associated with the steam generator. One of the two heating elements associated with the soleplate is referred to as main heating element, whereas another of these two heating elements is referred to as auxiliary heating element. During operation of the steam iron, a position of the switching means determine which heating elements are used. In a first position of the switching means, both the main heating element associated with the soleplate and the heating element associated with the steam generator are used, whereas in a second position of the switching means, both the main heating element associated with the soleplate and the auxiliary heating element associated with the soleplate are used. Thus, a situation in which one heating element associated with the soleplate is exclusively heated does not occur. Consequently, the power density for the heating elements associated with the soleplate is limited under all circumstances, so that there is no need for these heating elements to be capable of absorbing maximum electric power. Therefore, in the steam iron according to the present invention, it is possible to apply flat resistive heating elements, without the risk of the heating elements breaking down.

In the steam iron according to the present invention, it is possible that the available electric power is applied to the fullest, regardless of the position of the switching means, so that the performance of the steam iron is optimal. In order to have this possibility realized, it is preferred that both the auxiliary heating element associated with the soleplate and the heating element associated with the steam generator are arranged in parallel to the main heating element associated with the soleplate. In such case, in the first position of the switching means, the total power is distributed among the main heating element associated with the soleplate and the heating element associated with the steam generator, whereas in the second position of the switching means, the total power is distributed among the main heating element associated with the soleplate and the auxiliary heating element associated with the soleplate.

In the first position of the switching means, the total power is used for both the purpose of heating the soleplate and the purpose of heating the steam generator, whereas in the second position of the switching means, the total power is used for the purpose of only heating the soleplate. In a practical embodiment of the steam iron, the mass of the steam generator is smaller than the mass of the soleplate, and the electric resistance of the heating element associated with the steam generator is lower than the electric resistance of the main heating element associated with the soleplate. In such an embodiment, the start-up time, i.e. the time it takes for the steam iron to get ready for use after having been activated by a user, may be relatively short. At the very start, the switching means are put in the first position, and the total power is used to heat both the soleplate and the steam generator. As the mass of the steam generator is smaller than the mass of the soleplate, and as the fraction of the total power delivered to the steam generator is higher than the fraction of the total power delivered to the soleplate, due to the fact that the electric resistance of the heating element associated with the steam generator is lower than the electric resistance of the main heating element associated with the soleplate, the steam generator will reach a pre-determined temperature at an early stage, while the soleplate is still in the process of heating up. As soon as the temperature of the steam generator has reached the pre-determined level, the position of the switching means is changed, and the total power is delivered to the soleplate, through the two heating elements associated with the soleplate. As a result, the soleplate heats up at maximum power, and reaches a pre-determined temperature relatively fast. In this way, a relatively short start-up time is realized.

Figure 2:
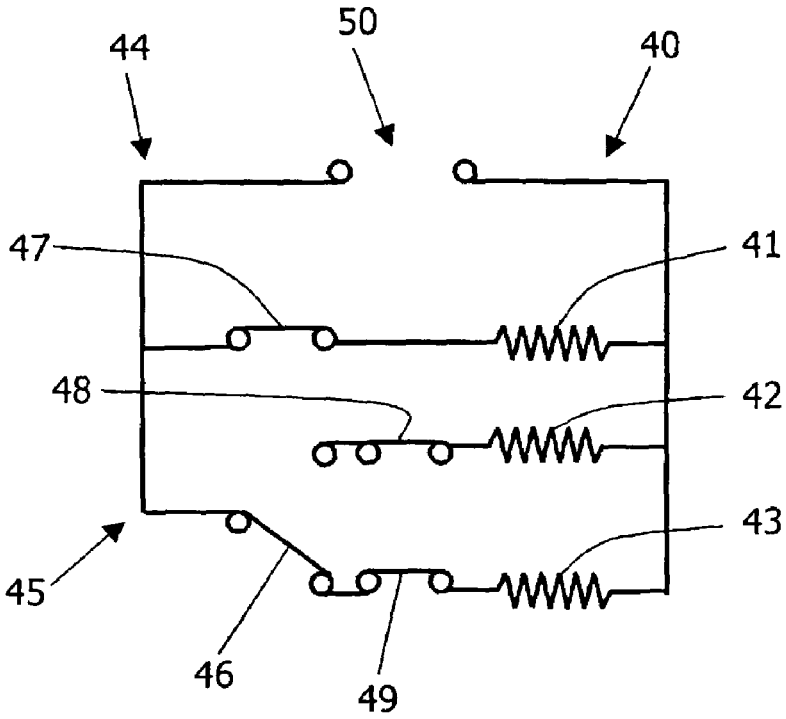
Figure 3:
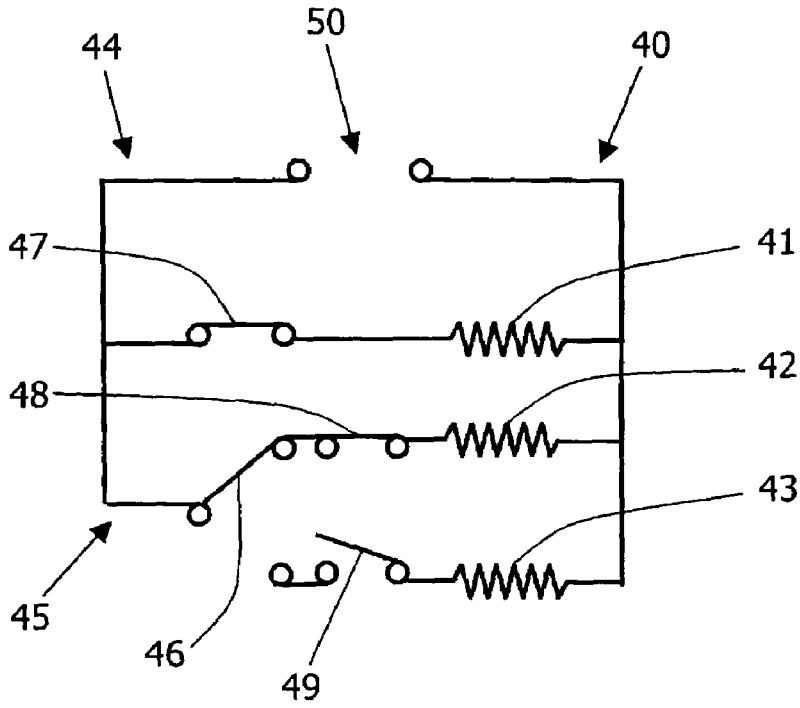
Figure 4:
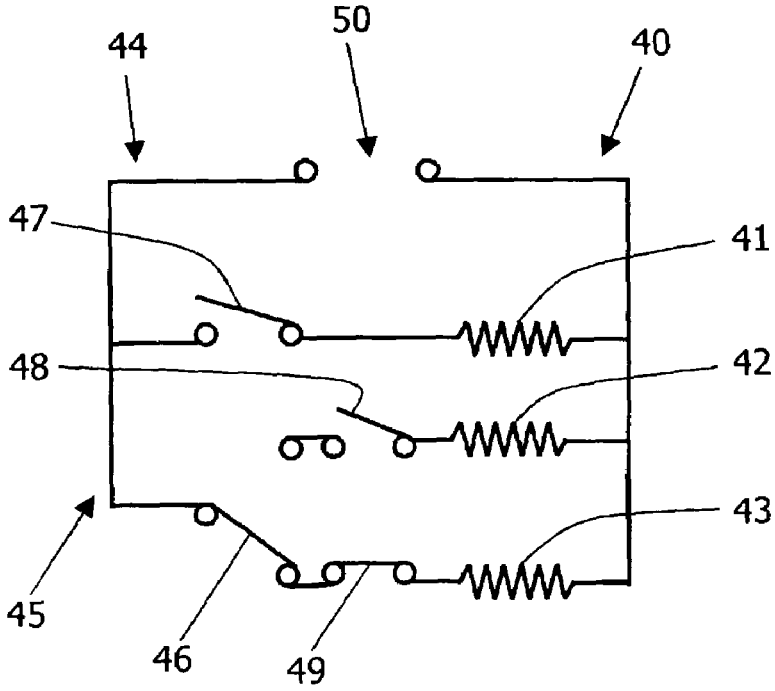
Figure 5:
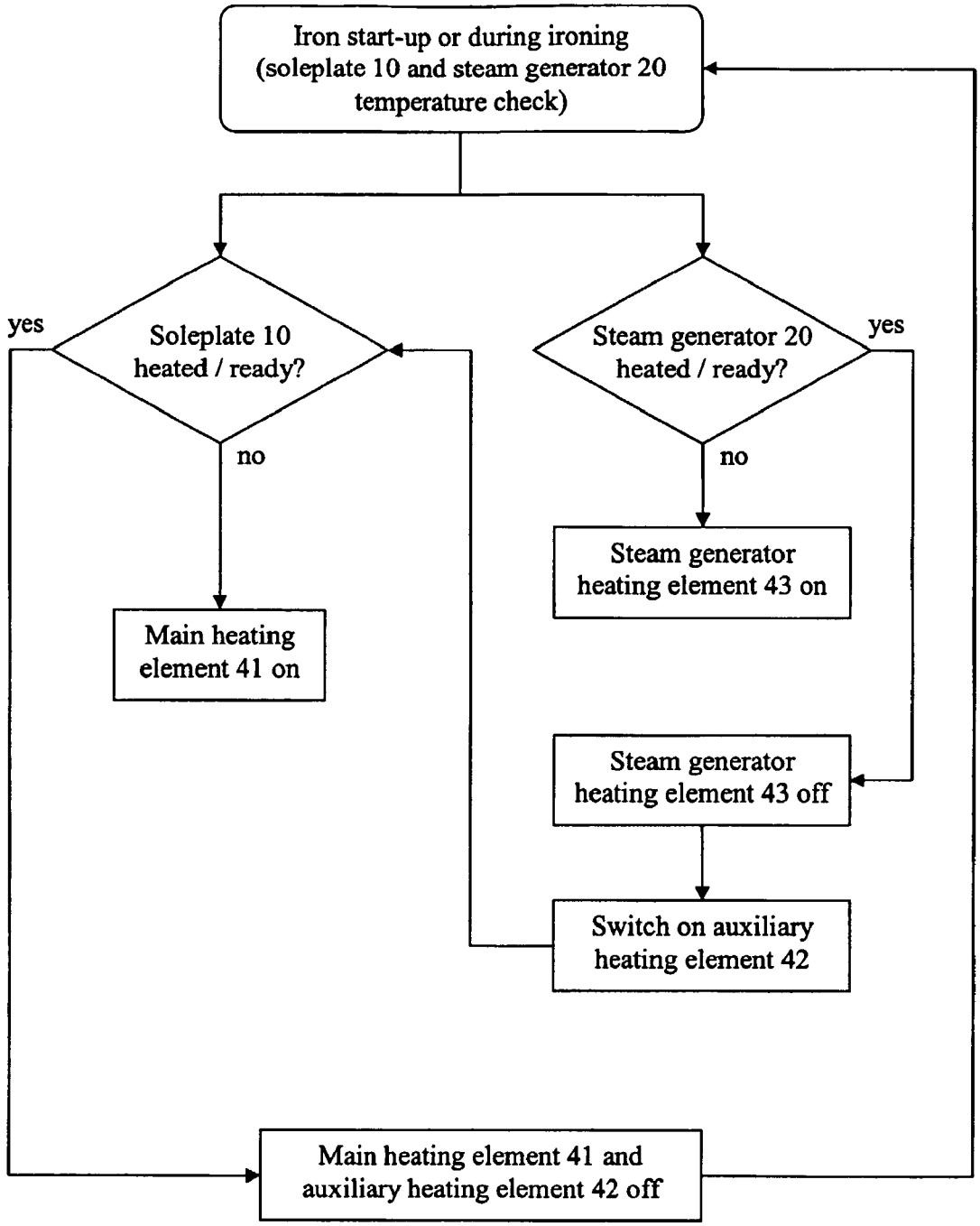

The present invention will now be explained in greater detail with reference to the Figures, in which similar parts are indicated by the same reference signs, and in which:

FIG. 1 diagrammatically shows a steam iron according to the present invention;

FIG. 2 diagrammatically shows a preferred embodiment of a heater circuit of the steam iron according to the present invention, in a first operating condition;

FIG. 3 diagrammatically shows the heater circuit shown in FIG. 2, in a second operating condition;

FIG. 4 diagrammatically shows the heater circuit shown in FIGS. 2 and 3, in a third operating condition; and FIG. 5 is a flowchart illustrating a preferred way of controlling the heater circuit shown in FIGS. 2-4.

FIG. 1 diagrammatically shows a steam iron 1 according to the present invention. A portion of the steam iron 1 is broken away for the purpose of showing components arranged inside the steam iron 1. The steam iron 1 comprises a soleplate 10 having a planar contacting surface 11 for contacting items to be ironed. In the soleplate 10, steam openings (not shown) for letting through steam are arranged. For the purpose of generating and supplying steam, the steam iron 1 comprises a steam generator 20. Both the soleplate 10 and the steam generator 20 may for example be made of an aluminum alloy.

Besides the soleplate 10 and the steam generator 20, the steam iron 1 comprises a housing 30, which is positioned on top of the soleplate 10, and which has a handle 31 to enable a user to pick up the steam iron 1 and move the contacting surface 11 of the soleplate 10 over an item to be ironed. In the shown example, the steam generator 20 is accommodated by the housing 30. That does not alter the fact that alternative embodiments in which the steam generator 20 is arranged outside of the housing 30 are also possible within the scope of the present invention. In such embodiments, the steam iron 1 preferably comprises a steam hose for conducting steam from the steam generator 20 to the steam openings in the soleplate 10.

During operation of the steam iron 1, both the soleplate 10 and the steam generator 20 are heated, and the steam iron 1 is fit to be used for de-wrinkling textile items, on the basis of contact between the hot contacting surface 11 of the soleplate 10 and the items on the one hand, and a supply of steam to the items on the other hand. For the purpose of heating the soleplate 10 and the steam generator 20, a heater circuit 40 comprising heating elements is provided. The steam iron 1 comprises an electric power cable 32, of which only a part is shown in FIG. 1, for providing a connection between the heater circuit 40 and an electric power source (not shown in FIG. 1).

Preferably, according to the present invention, the heating elements comprise flat resistive heating elements. According to an important aspect of the present invention, two heating elements are associated with the soleplate 10, whereas one heating element is associated with the steam generator 20. One of the two heating elements associated with the soleplate 10 is referred to as main beating element 41. Another of the two heating elements associated with the soleplate 10 is referred to as auxiliary heating element 42. The heating element associated with the steam generator 20 is referred to as steam generator heating element 43.

In the shown embodiment of the steam iron 1 according to the present invention, the steam generator 20 weighs far less than the soleplate 10. For example, the steam generator 20 weighs 250 grams, while the soleplate 10 weighs 800 grams. The steam generator 20 may have any suitable shape. According to one possibility, the steam generator 20 comprises a small piece of metal, which is capable of letting through a stream of water. This type of steam generator 20 is not capable of storing water, and is kept dry during the periods of time in which no steam is required. During operation of the steam iron 1, the steam generator 20 is kept at a more or less constant temperature, for example 160° C., so that water that is injected into the steam generator 20 is immediately evaporated.

The steam iron 1 comprises a water tank 21 for containing water that is to be supplied to the steam generator 20 in case steam is required by a user of the steam iron 1. In the shown example, the water tank 21 is located outside of the housing 30 of the steam iron 1. In comparison with a water tank located inside the housing 30, a water tank 21 located outside of the housing 30 has many advantages. One of these advantages is that there is no need of adapting the size of the water tank 21 to the size of the housing 30 of the steam iron 1. Consequently, the water tank 21 may be so large that it is not necessary to fill it often. In cases in which the water tank 21 is positioned inside of the housing 30 of the steam iron 1, a larger water tank 21 may mean a lower frequency of filling the water tank 21, but is also means a bulkier and heavier steam iron 1. Within the scope of the present invention, although it is preferred to have the water tank 21 located inside the housing 30, it is not relevant whether the water tank 21 is located inside or outside of the housing 30 of the steam iron.

In the example of the steam iron 1 as shown in FIG. 1, the water tank 21 is connected to the steam generator 20 through a suitable hose 22.

The configuration of the heater circuit 40 and various operating conditions of the heater circuit 40 are diagrammatically shown in FIGS. 2-4, and will be explained in the following. In FIGS. 2-4, the electric power source is diagrammatically shown and indicated by reference numeral 50.

The heater circuit 40 comprises two parallel loops, wherein the main heating element 41 is arranged in a first loop 44, and wherein the auxiliary heating element 42 and the steam generator heating element 43 are arranged in a second loop 45. In this configuration, both the auxiliary heating element 42 and the steam generator heating element 43 are arranged in parallel to the main heating element 41. In the second loop 45, a selector switch 46 is arranged, for either connecting the auxiliary heating element 42 to the electric power source 50, or connecting the steam generator heating element 43 to the electric power source 50. Hence, the selector switch 46 is only capable of connecting either one of the auxiliary heating element 42 and the steam generator heating element 43 to the electric power source 50. As a consequence, it is not possible for the auxiliary heating element 42 and the steam generator heating element 43 to be powered at the same time. In the following, a position of the selector switch 46 in which the selector switch 46 connects the steam generator heating element 43 to the power source 50 and disconnects the auxiliary heating element 42 from the power source 50 will be referred to as first position, whereas a position of the selector switch 46 in which the selector switch 46 connects the auxiliary heating element 42 to the power source 50 and disconnects the steam generator heating element 43 from the power source 50 will be referred to as second position.

Besides the selector switch 46, the heater circuit 40 comprises three connecting switches, wherein a first connecting switch 47 is arranged in series with the main heating element 41, wherein a second connecting switch 48 is arranged in series with the auxiliary heating element 42, and wherein a third connecting switch 49 is arranged in series with the steam generator heating element 43. Preferably, all three connecting switches 47, 48, 49 are operable in response to the temperature of the associated component of the steam iron 1, i.e. the soleplate 10 in case of the first connecting switch 47 and the second connecting switch 48, and the steam generator 20 in case of the third connecting switch 49, wherein the connecting switches 47, 48, 49 are in the opened position when a temperature of the associated component is at a pre-determined temperature or higher than the pre-determined temperature, and wherein the connecting switches 47, 48, 49 are in the closed position when a temperature of the associated component is lower than a pre-determined temperature. In a practical embodiment, the connecting switches 47, 48, 49 comprise thermostats.

In a first position, which is also referred to as a closed position, the first connecting switch 47 connects the main heating element 41 to the power source 50, whereas in a second position, which is also referred to as an opened position, the first connecting switch 47 disconnects the main heating element 41 from the power source 50. The positions of both the second connecting switch 48 and the third connecting switch 49 may also be closed or opened. In the opened position, the second connecting switch 48 and the third connecting switch 49 disconnect the auxiliary heating element 42 and the steam generator heating element 43, respectively, from the power source 50. In the closed position, the second connecting switch 48 and the third connecting switch 49 are capable of connecting the auxiliary heating element 42 and the steam generator heating element 43, respectively, to the power source 50, dependent of the position of the selector switch 46. In case the second connecting switch 48 is closed, it is necessary that the selector switch 46 is in the second position in order to have a connection between the auxiliary heating element 42 and the power source 50. If the selector switch 46 is in the first position, there is no such connection, despite of the fact that the second connecting switch 48 is in the closed position. Likewise, in case the third connecting switch 49 is closed, it is necessary that the selector switch 46 is in the first position in order to have a connection between the steam generator heating element 43 and the power source 50. If the selector switch 46 is in the second position, there is no such connection, despite of the fact that the third connecting switch 49 is in the closed position.

For the purpose of controlling the heater circuit 40, in particular the selector switch 46, the steam iron 1 comprises a micro-controller (not shown). It is possible that the micro-controller is programmed such as to control the positions of the connecting switches 47, 48, 49 as well. In such case, temperature sensing means (not shown) are arranged, which are capable of transmitting signals representing the actual temperature of the soleplate 10 and the steam generator 20 to the micro-controller, wherein pre-determined temperatures for the soleplate 10 and the steam generator 20 are stored in the micro-controller. Within the scope of the present invention, the practical embodiment of the temperature sensing means may be chosen freely. For example, the connecting switches 47, 48, 49 may comprise electronic thermostats. In the following description of the heater circuit 40 and the way in which it is controlled, it is assumed that the connecting switches 47, 48, 49 comprise electronic thermostats which are controlled by the micro-controller. However, it is also possible that the connecting switches 47, 48, 49 do not need input from a micro-controller to determine their respective positions, for example in case the connecting switches 47, 48, 49 comprise mechanical thermostats or the like. In such case, part of the controlling function of the micro-controller is taken over by the thermostats themselves. Moreover, apart from micro-controllers, simple electronic circuitry can also be applied for controlling the temperature of the soleplate 10 and the steam generator 20 via electronic thermostats.

The heater circuit 40 is controlled on the basis of an ongoing comparison between the requirements imposed on the steam iron 1 by a user and the actual condition of the components of the steam iron 1, in particular the soleplate 10 and the steam generator 20. In case a difference is found, the micro-controller is programmed such as to activate one or heating elements 41, 42, 43 by adjusting the position of one or more switches 46, 47, 48, 49 in an appropriate manner, in order to decrease the difference and bring the actual condition of the components of the steam iron 1 into conformity with the requirements of the user as fast as possible.

The steam iron 1 offers the user at least the opportunity to set the temperature of the soleplate 10. In FIG. 1, a rotatable control wheel 33 is shown. Every position of the control wheel 33 with respect to the housing 30 of the steam iron 1 represents a required temperature of the soleplate 10, and determines a setting in the micro-controller. The control wheel 33 is often referred to as thermostat dial or temperature dial, and constitutes a handy tool for the user to adjust the temperature of the soleplate 10 to the type of fabric that is to be ironed. In some recent market available irons, the temperature dial is replaced by temperature adjustment buttons.

FIG. 5 is a flowchart illustrating a preferred way of controlling the heater circuit 40. A first step involves a check of the temperature of both the soleplate 10 and the steam generator 20. This step is continually repeated during the operation of the steam iron 1.

In case it appears that the temperature of the steam generator 20 is lower than a pre-determined temperature, i.e. a temperature at which a desired steaming rate is obtained, the third connecting switch 49 is put in the closed position, and the selector switch 46 is put in the first position, so that the steam generator heating element 43 is connected to the electric power source 50. At the same time, in case it appears that the temperature of the soleplate 10 is lower than a pre-determined temperature, the first connecting switch 47 is put in the closed position, so that the main heating element 41 is connected to the electric power source 50. Since the temperature of the soleplate 10 is lower than the pre-determined temperature, the second connecting switch 48 is put in the closed position as well. The obtained configuration of the heater circuit 40 is illustrated by FIG. 2.

Despite of the fact that the second connecting switch 48 is in the closed position, the auxiliary heating element 42 is disconnected from the electric power source 50, as the selector switch 46 is in the first position. It is clear that when the selector switch 46 is in the first position, the auxiliary heating element 42 is disconnected from the electric power source 50, irrespective of the position of the second connecting switch 48.

As soon as the check of the temperature of the steam generator 20 points out that the pre-determined temperature has been reached, it is no longer necessary to operate the steam generator heating element 43. In that case, the third connecting switch 49 is put in an opened position, and the selector switch 46 is put in a second position, so that the auxiliary heating element 42 is connected to the electric power source 50. The obtained configuration of the heater circuit 40 is illustrated by FIG. 3. In this configuration of the heater circuit 40, the soleplate 10 is heated by both the main heating element 41 and the auxiliary heating element 42.

As soon as the check of the temperature of the soleplate 10 points out that the pre-determined temperature has been reached, both the first connecting switch 47 and the second connecting switch 48 are put in the opened position, so that the main heating element 41 and the auxiliary heating element 42 get disconnected from the electric power source 50. In case the check of the temperature of the steam generator 20 points out that this temperature is below the pre-determined temperature, the third connecting switch 49 is put in the closed position, and the selector switch 46 is put to the first position, so that the steam generator heating element 43 is connected to the electric power source 50. The obtained configuration of the heater circuit 40 is illustrated by FIG. 4. However, in case the pre-determined temperature of the steam generator 20 appears to have been reached as well, the third connecting switch 49 remains in the opened position, and the selector switch 46 remains in the second position. In such case, all heating elements 41, 42, 43 are disconnected from the electric power source 50, as all connecting switches 47, 48, 49 are in the opened position. Furthermore, the position of the selector switch 46 is unimportant, as it does not influence the condition of the heating elements 41, 42, 43.

Starting from the situation in which none of the heating elements 41, 42, 43 is connected to the electric power source 50, and in which the selector switch 46 is in the second position, different possibilities exist for activating the heater circuit 40 again.

According to a first possibility, the temperature of the soleplate 10 gets lower than the associated pre-determined temperature, whereas the temperature of the steam generator 20 is still higher than or equal to the associated pre-determined temperature. In that case, both the first connecting switch 47 and the second connecting switch 48 are put in the closed position, while the selector switch 46 remains in the second position. Consequently, both the main heating element 41 and the auxiliary heating element 42 are connected to the electric power source 50. The third connecting switch 49 remains in the opened position.

According to a second possibility, the temperature of the steam generator 20 gets lower than the associated pre-determined temperature, whereas the temperature of the soleplate 10 is still higher than or equal to the associated pre-determined temperature. In that case, only the third connecting switch 49 is put in the closed position, and the selector switch 46 is put in the first position. Consequently, the steam generator heating element 43 is connected to the electric power source 50, while both the main heating element 41 and the auxiliary heating element 42 remain disconnected from the electric power source 50.

According to a third possibility, the temperature of the soleplate 10 gets lower than the associated pre-determined temperature, and the temperature of the steam generator 20 gets lower than the associated pre-determined temperature as well. In that case, all three connecting switches 47, 48, 49 are put in the closed position. Additionally, the selector switch 46 is put in the first position. In this way, a configuration of the heater circuit 40 is obtained, in which both the main heating element 41 and the steam generator heating element 43 are connected to the electric power source 50, while the auxiliary heating element 42 is disconnected from the electric power source 50. The auxiliary heating element 42 remains disconnected from the electric power source 50 until the temperature of the steam generator 20 has reached the pre-determined value and the third connecting switch 49 is put in the opened position.

As a rule, the auxiliary heating element 42 is only activated when there is no need for activating the steam generator heating element 43. As long as it is necessary to supply power to the steam generator 20 in order to heat up the steam generator 20, the power supplied by the electric power source 50 is distributed among the soleplate 10 and the steam generator 20. Only in case the steam generator 20 is at an appropriate temperature, the full power supplied by the electric power source 50 is delivered to the soleplate 10, through the main heating element 41 and the auxiliary heating element 42. Hence, in the micro-controller, the steam generator heating element 43 has priority over the auxiliary heating element 42, so that the auxiliary heating element 42 will never be activated in a situation in which the steam generator 20 still needs to heat up. This implies that as long as the temperature of the steam generator 20 is lower than the pre-determined temperature, the selector switch 46 is in the first position, and that the selector switch 46 is only put in the second position when there is no need for heating the steam generator 20, in other words, when the temperature of the steam generator 20 is at the pre-determined temperature or higher than the pre-determined temperature.

An important advantage of the way in which the heater circuit 40 is controlled, wherein a process of heating the steam generator 20 has priority over a process of heating the soleplate 10 at full power, is that the steam iron 1 is always capable of providing steam, even if the soleplate 10 is not at the required temperature. As the method of controlling the heater circuit 40 is aimed at keeping the steam generator 20 at the pre-determined temperature at all times, the steam generator 20 will always be capable of evaporating the water that is forced to pass the steam generator 20. Consequently, undesired situations, such as a situation in which the steam iron 1 spits droplets of water when it is required to have a release of steam, are prevented.

In the heater circuit 40 according to the present invention, a situation in which only one heating element associated with the soleplate 10, i.e. the main heating element 41 and the auxiliary heating element 42, is powered does not occur. The main heating element 41 is always powered together with either the auxiliary heating element 42 or the steam generator heating element 43, and the auxiliary heating element 42 is always powered together with the main heating element 41. Consequently, the power supplied by the electric power source 50 is never fully absorbed by any of the main heating element 41 and the auxiliary heating element 42. This is very advantageous in case these heating elements 41, 42 comprise flat resistive heating elements. Despite of the fact that the temperature of the soleplate 10 may be relatively high, for example 210° C., the performance of the flat resistive heating elements is still reliable, as the power density of the heating elements is limited. In respect of the heating element 43 associated with the steam generator 20, it is noted that the maximum operating temperature of this heating element 43 is lower, so that it is no problem for this heating element 43 to remain intact if it is to absorb the full power supplied by the electric power source 50.

The steam iron 1 according to the present invention, having the heater circuit 40 as described in the foregoing, is compliant with IEC-regulations on EMC. In this respect, the fact that the main heating element 41 may remain connected to the electric power source 50 when a switch between the auxiliary heating element 42 and the steam generator heating element 43 is made plays an important role.

In a preferred embodiment, the steam generator 20 weighs less than the soleplate 10. For example, the steam generator 20 weighs 250 grams, while the soleplate 10 weighs 800 grams. Furthermore, in the preferred embodiment, the resistance of the steam generator heating element 43 is lower than the resistance of the main heating element 41. For example, the resistance of the steam generator heating element 43 is 35.3 Ohms, while the resistance of the main heating element 41 is 66.1 Ohms. As a result, when the steam generator heating element 43 and the main heating element 41 are connected in parallel to one and the same power source, the power absorbed by the main heating element 41 is lower than the power absorbed by the steam generator heating element 43. Preferably, the resistance of the auxiliary heating element 42 is the same as the resistance of the steam generator heating element 43.

An important advantage of the steam iron 1 according to the present invention becomes apparent when a start-up situation of the preferred embodiment as defined in the preceding paragraph is considered, in which the initial temperatures of both the soleplate 10 and the steam generator 20 are similar to the ambient temperature. In this situation, it is clear that both the soleplate 10 and the steam generator 20 need to be heated in order to bring the steam iron 1 in an operational condition. Therefore, at the very start, all connecting switches 47, 48, 49 are put in the closed position, and the selector switch 46 is put to the first position, so that both the main heating element 41 and the steam generator heating element 43 are connected to the electric power source 50. Given the fact that the weight of the steam generator 20 is lower than the weight of the soleplate 10, and the power absorbed by the steam generator heating element 43 is higher than the power absorbed by the main heating element 41, the steam generator 20 heats up much faster than the soleplate 10. For example, the total power supplied by the electric power source 50 is 2300 W, of which 800 W is absorbed by the main heating element 41, and of which 1500 W is absorbed by the steam generator heating element 43. In that case, further assuming that the heating elements 41, 42, 43 comprise flat resistive heating elements, the steam generator 20 reaches a pre-determined temperature of 160° C. in approximately 20.6 seconds. At that time, the soleplate 10 is still in the process of heating up. From the moment the steam generator 20 has reached the pre-determined temperature, the process of heating up the soleplate 10 can take place at a higher rate, as the selector switch 46 is put to the second position, in which the steam generator heating element 43 is disconnected from the electric power source 50, and in which the auxiliary heating element 42 is connected to the electric power source 50. From that moment on, the full power supplied by the electric power source 50 is exclusively used for heating the soleplate 10. As a result, the soleplate 10 is capable of reaching a pre-determined starting temperature of 110° C. in approximately 41.1 seconds, which is very fast compared to a conventional situation in which it is not possible to make use of flat resistive heating elements and, at the same time, supplying full power to the soleplate 10 for at least a fraction of the start-up time. In such a situation, heating up the same soleplate 10 and the same steam generator 20 takes approximately 79.5 seconds, which is almost twice as much time as 41.1 seconds.

As a consequence of the fact that according to the present invention, it is possible to heat up the soleplate 10 very fast, it is also possible to have a relatively high initial steaming rate. In addition to the heat energy supplied directly to the steam generator 20 by the steam generator heating element 43, the heat energy stored in the soleplate 10 is also used in the process of putting water to steam. This is not only true at the start of an ironing process, but also throughout an ironing process. In case the temperature of the soleplate 10 has dropped, it is very quickly brought back to a pre-determined level again, as soon as it is possible to temporarily stop the supply of power to the steam generator 20 and supply all of the available power to the soleplate 10. Thus, when the steam iron 1 according to the present invention is applied, it is possible to quickly heat up the soleplate 10 to a pre-determined temperature, and also to have a relatively high steaming rate.

The fact that the steam iron 1 according to the present invention is heated up relatively fast is not only advantageous at the start of an ironing process, but also throughout the ironing process. When the contacting surface 11 of the soleplate 10 touches an item to be ironed, the soleplate 10 loses heat and requires power in order to maintain a set temperature. When steam passes through the steam openings in the soleplate 10, there is even more loss of heat. Therefore, the fact that full heating power may be supplied to the soleplate 10 whenever there is no need to heat the steam generator 20 is advantageous. In this way, the soleplate 10 may be put back to the pre-determined temperature relatively fast. For example, the loss of heat results in a temperature drop of 20° C. of the soleplate 10. When the soleplate 10 and the steam generator 20 having the above-described characteristics, in particular a weight of 800 grams and 250 grams, respectively, are heated in a conventional manner, the time it takes for the temperature of the soleplate 10 to get back at the set value is approximately 17.7 seconds. When the soleplate 10 and the steam generator 20 are heated according to the present invention by means of heating elements 41, 42, 43 having the above-described characteristics, in particular resistances of 66.1 Ohms and 35.3 Ohms, wherein full power may be supplied to the soleplate 10 as soon as the steam generator 20 is at the pre-determined temperature, the time is 6.1 seconds, which is significantly less than the conventional time of 17.7 seconds.

It will be clear to a person skilled in the art that the scope of the present invention is not limited to the examples discussed in the foregoing, but that several amendments and modifications thereof are possible without deviating from the scope of the present invention as defined in the attached claims.

For example, it is not necessary that the steam iron 1 comprises just one heating element for heating the steam generator 20. Instead, it is possible to also provide more than one of such heating elements. Similarly, there may be more than two heating elements associated with the soleplate 10. In all possible embodiments of the steam iron according to the present invention, it is important that it is possible to supply full power to the soleplate 10 on the one hand, while avoiding a situation in which only one heating element associated with the soleplate 10 is powered on the other hand.

Many alternatives exist for the way in which the heater circuit 40 may be controlled. In the foregoing, one option is described, according to which both the soleplate 10 and the steam generator 20 are heated simultaneously, until the steam generator 20 is at a pre-determined temperature. From that moment on, all available power is supplied to the soleplate 10 until this component of the steam iron 1 has reached a predetermined temperature as well. Another option is that the soleplate 10 and the steam generator 20 are alternately heated at full power, according to a predetermined scheme laid down in the micro-controller. For example, the soleplate 10 is heated 7 seconds, the steam generator 20 is heated 2 seconds, the soleplate 10 is heated 7 seconds again, the steam generator 20 is heated 3 seconds, and so on until one of the soleplate 10 and the steam generator 20 is at the pre-determined temperature.

In the foregoing, a steam iron 1 having a soleplate 10 and a steam generator 20 has been disclosed, which comprises a heater circuit 40 having two parallel loops 44, 45, wherein a main soleplate heating element 41 is arranged in a first loop 44, and wherein an auxiliary soleplate heating element 42 and a steam generator heating element 43 are arranged in a second loop 45. In the second loop 45, a selector switch 46 is arranged, for either connecting the auxiliary soleplate heating element 42 or the steam generator heating element 43 to an electric power source 50.

A position of the selector switch 46 is determinative of an operating condition of the heater circuit 40. In one possible operating condition of the heater circuit 40, both the main soleplate heating element 41 and the steam generator heating element 43 are connected to the electric power source 50, while the auxiliary soleplate heating element 42 is disconnected from this power source 50. In another possible operating condition of the heater circuit 40, both soleplate heating elements 41, 42 are connected to the electric power source 50, while the steam generator heating element 43 is disconnected from this power source 50. In this operating condition, the soleplate 10 heats up fast, as all available electric power is used for heating the soleplate 10.

Preferably, the heating elements 41, 42, 43 comprise flat resistive heating elements. An important feature of the steam iron 1 according to the present invention is that all available power may be used for heating the soleplate 10, in situations in which it is not necessary to activate the steam generator heating element 43. As advantageous results of this feature, it takes relatively little time for the steam iron 1 to get ready for use, and it is possible to achieve a relatively high steaming rate.

According to the present invention, a steam iron 1 is provided, which comprises the following components:

a soleplate 10 having a contacting surface 11 for contacting items to be ironed;

a steam generator 20;

a main heating element 41 and an auxiliary heating element 42, which are associated with the soleplate 10, and which, upon receipt of power, preferably electric power, are capable of heating the soleplate 10;

a heating element 43 associated with the steam generator 20, which, upon receipt of power, preferably electric power, is capable of heating the steam generator 20; and switching means 46 for either allowing a supply of power to the heating element 43 associated with the steam generator 20 and interrupting a supply of power to the auxiliary heating element 42 associated with the soleplate 10, or allowing a supply of power to the auxiliary heating element 42 associated with the soleplate 10 and interrupting a supply of power to the heating element 43 associated with the steam generator 20.

According to an important aspect of the present invention, in case the main heating element 41 associated with the soleplate 10 is connected to a power source 50, one of the auxiliary heating element 42 associated with the soleplate 10 and the heating element 43 associated with the steam generator 20 is connected to the power source 50 as well.

The present invention is also related to a soleplate module, or soleplate assembly as it is often referred to as well, for use in a steam iron 1 according to the present invention. Such a soleplate module comprises at least the soleplate 10, the main heating element 41 and the auxiliary heating element 42.

In an alternative embodiment of a steam iron comprising the heater circuit 40 according to the present invention, the auxiliary heating element 42 is operated together with the main heating element 41 only when the temperature of the soleplate 10 is within a certain temperature range, for example a temperature range up to 120° C. The heater circuit 40 of such a steam iron is controlled in the same manner as the heater circuit 40 of the steam iron 1 shown in the Figures, except for the fact that the second connecting switch 48 is only put in the closed position when two requirements are fulfilled, i.e. when the temperature of the soleplate 10 is below the temperature set for the soleplate 10, and when the temperature of the soleplate 10 is within the temperature range associated with operation of the auxiliary heating element 42. In case the temperature of the soleplate 10 is below the temperature set for the soleplate 10 and outside of the temperature range associated with operation of the auxiliary heating element 42, the second connecting switch 48 is kept in the opened position, so that the auxiliary heating element 48 is kept disconnected from the electric power source 50, despite of the fact that the soleplate 10 needs to be heated. Consequently, when the temperature of the soleplate 10 is outside of the temperature range associated with operation of the auxiliary heating element 42, heating of the soleplate 10 only takes place by means of the main heating element 41, wherein only a fraction of the available electric power is applied. It is only possible to apply full power for heating the soleplate 10 when the temperature of the soleplate 10 is below the maximum temperature of the temperature range associated with operation of the auxiliary heating element 42.

On the basis of the preceding paragraph, it is clear that when the auxiliary heating element 42 is only operated when the temperature of the soleplate 10 is within a certain range, it is not possible to apply full power in all situations in which only the soleplate 10 needs to be heated up. However, it is still possible to apply full power for heating up the soleplate 10 when it is needed most to do so, namely at the start of an ironing process. An important advantage of not using the auxiliary heating element 42 when the temperature of the soleplate 10 is above a pre-determined temperature is that the auxiliary heating element 42 may be more robust, as a situation in which the auxiliary heating element 42 needs to absorb a relatively large fraction of the available electric power and is subjected to the influence of a relatively high temperature on top of that is avoided.

The invention claimed is:

1. Steam iron, comprising:

a soleplate having a contacting surface for contacting items to be ironed;

a steam generator;

a main heating element and an auxiliary heating element, which are associated with the soleplate, and which, upon receipt of electric power, are capable of heating the soleplate;

a heating element associated with the steam generator, which upon receipt of electric power, is capable of heating the steam generator; and switching means for connecting either the heating element associated with the steam generator or the auxiliary heating element associated with the soleplate to a power source for supplying electric power.

2. The steam iron according to claim 1, wherein both the auxiliary heating element associated with the soleplate and the heating element associated with steam generator are arranged in parallel to the main heating element associated with the soleplate.

3. Steam iron according to claim 1, further comprising:

first connecting means for connecting and disconnecting the main heating element associated with the soleplate to the power source.

4. The steam iron according to claim 3, wherein the first connecting means are operable in response to an actual temperature of the soleplate.

5. The steam iron according to claim 1, further comprising:

second connecting means for connecting and disconnecting a supply of electric power from the power source to the auxiliary heating element.

6. The steam iron according to claim 5, wherein the second connecting means are operable in response to an actual temperature of the soleplate.

7. Steam iron according to claim 1, further comprising:

third connecting means for connecting and disconnecting a supply of electric power from the power source to the steam generator heating element.

8. The steam iron according to claim 7, wherein the third connecting means are operable in response to an actual temperature of the steam generator.

9. The steam iron according to claim 1, wherein the steam generator is accompanied by a housing which is positioned on top of the soleplate, wherein the steam generator weighs less than the soleplate, and wherein the steam generator is adapted to receive water and to heat the received water to steam.

10. The steam iron according to claim 1, wherein an electric resistance of the auxiliary heating element associated with the soleplate is equal to an electric resistance of the heating element associated with the steam generator.

11. The steam iron according to claim 1, wherein each of the main heating element and the auxiliary heating element comprises a flat resistive heating element.

12. A soleplate module, configured for use in the steam iron according to claim 1.

13. A method for operating a steam iron, comprising a soleplate and a steam generator, the method comprising:

providing electric power to a main heating element of the steam iron to heat the soleplate through the main heating element;

selecting one of an auxiliary heating element and a steam generator heating element of the steam iron;

providing electric power to the auxiliary heating element to heat the soleplate through the auxiliary heating element only when the auxiliary heating element is selected; and providing electric power to the steam generator heating element to heat the steam generator through the steam generator heating element only when the steam generator heating element is selected.

14. The method according to claim 13, wherein the electric power is provided to the main heating element associated with the soleplate together with the electric power being provided to the selected one of the auxiliary heating element associated with the soleplate and the steam generator heating element associated with the steam generator.

15. The method according to claim 14, further comprising:

checking whether a temperature of the steam generator has reached a pre-determined temperature, wherein the steam generator heating element is selected only when the pre-determined temperature has not been reached, and wherein the auxiliary heating element is selected only when the pre-determined temperature has been reached.

16. A steam iron, comprising:

a soleplate comprising a contacting surface for contacting an item to be ironed;

a steam generator configured to generate steam from water;

a first heating element configured to heat the soleplate;

a second heating element configured to heat the soleplate with the first heating element;

a third heating element configured to heat the steam generator; and a switch configured to selectively connect one of the second heating element and the third heating element to a power source to receive electric power, the connected one of the second heating element and the third heating element heating the soleplate and the steam generator, respectively, while receiving the electric power.

17. The steam iron of claim 16, wherein the first heating element is in a first loop, and the second and third heating elements are in a second loop which is parallel to the first loop.

18. The steam iron of claim 17, further comprising:

a first heating element switch configured to selectively connect the first heating element to the power source in response to a first predetermined temperature of the soleplate.

19. The steam iron of claim 18, further comprising:

a second heating element switch configured to selectively connect the second heating element to the power source in response to a second predetermined temperature of the soleplate.

20. The steam iron of claim 19, further comprising:

a third heating element switch configured to selectively connect the third heating element to the power source in response to a predetermined temperature of the steam generator.

* * * * *